US012305344B1

(12) United States Patent
Zhou et al.

(10) Patent No.: US 12,305,344 B1
(45) Date of Patent: May 20, 2025

(54) MOUNTING METHOD OF A MAIN BEAM OF A DOUBLE-SIDED STEEL BOX UHPC COMPOSITE BEAM CABLE-STAYED BRIDGE AND COMPOSITE BEAM THEREOF

(71) Applicant: CCCC Second Harbor Engineering Company Ltd., Wuhan (CN)

(72) Inventors: Fanwu Zhou, Wuhan (CN); De'an Yu, Wuhan (CN); Haitao Gao, Wuhan (CN); Nannan Zhang, Wuhan (CN); Peng Liu, Wuhan (CN); Zhenghui Luo, Wuhan (CN); Run Nie, Wuhan (CN); Xiaoke Zeng, Wuhan (CN)

(73) Assignee: CCCC Second Harbor Engineering Company Ltd., Wuhan (CN)

( * ) Notice: Subject to any disclaimer, the term of this patent is extended or adjusted under 35 U.S.C. 154(b) by 0 days.

(21) Appl. No.: 18/769,099

(22) Filed: Jul. 10, 2024

(51) Int. Cl.
*E01D 21/00* (2006.01)

(52) U.S. Cl.
CPC ..... *E01D 21/00* (2013.01)

(58) Field of Classification Search
CPC ..... E01D 21/00
USPC ..... 14/73–74.5, 77.1
See application file for complete search history.

(56) References Cited

U.S. PATENT DOCUMENTS 504,559 A * 9/1893 Clarke ..... E01D 11/04 14/8
4,799,279 A * 1/1989 Muller ..... E01D 19/14 14/18
5,511,266 A * 4/1996 Dinis ..... E01D 21/06 14/2.5
5,511,268 A * 4/1996 Albus ..... E01D 21/06 212/312
5,896,609 A * 4/1999 Lin ..... E01D 21/105 14/18
5,940,916 A * 8/1999 Sauvageot ..... E01D 21/06 14/2.5
5,966,764 A * 10/1999 Vodicka ..... E01D 19/02 14/77.1
2007/0163058 A1* 7/2007 Homsi ..... E01D 19/103 14/77.1
2012/0216357 A1* 8/2012 Byun ..... E01D 11/04 14/77.1

(Continued)

FOREIGN PATENT DOCUMENTS

CN 105803948 B 7/2016
EP 3303707 B1 * 6/2019 ..... E01D 19/125
KR 1344690 B1 * 12/2013 ..... E02D 21/00

*Primary Examiner* — Raymond W Addie
(74) *Attorney, Agent, or Firm* — Goodhue, Coleman & Owens, P.C.

(57) ABSTRACT

Provided is a mounting method of a main beam of a double-sided steel box UHPC composite beam cable-stayed bridge and a composite beam thereof. The method includes the following steps: carrying out prestressed tensioning in a transverse direction of the bridge for all beam segments; pouring UHPC when a wet joint between a second beam segment and a third beam segment located in front of an end beam segment is in a pre-bending state; initially matching and positioning the end beam segment and a beam segment to be mounted; tensioning a n-th stay cable corresponding to the end beam segment for the first time; tensioning the n-th stay cable for the second time to a designed cable force.

9 Claims, 8 Drawing Sheets

(56) References Cited

U.S. PATENT DOCUMENTS

2021/0363711 A1* 11/2021 He ..... E01D 19/125

* cited by examiner

MOUNTING METHOD OF A MAIN BEAM OF A DOUBLE-SIDED STEEL BOX UHPC COMPOSITE BEAM CABLE-STAYED BRIDGE AND COMPOSITE BEAM THEREOF

TECHNICAL FIELD

The present disclosure relates to the technical field of bridge construction, and in particular to a mounting method of a main beam of a double-sided steel box UHPC (ultra-high-performance concrete) composite beam cable-stayed bridge and composite beam thereof.

BACKGROUND

A structure with a double-sided steel box UHPC composite beam having the advantages of simple structure, light self-weight, and convenient construction and hoisting, and a bridge deck made of the ultra-high-performance concrete (UHPC) material and having excellent force performance, the structure is gradually widely used in the design and construction of long-span cable-stayed bridges.

A cantilever assembly method of a bridge deck crane is normally adopted in the construction of a steel main beam of the cable-stayed bridge. Compared with a normal steel box beam, the main beam of the double-sided steel box has the characteristics of rigid on both sides and flexible in the middle. When the beam segment is hoisted through the bridge deck crane, the self-weight of the beam segment and the weight of the bridge deck crane will be transferred to front and rear anchor points of the bridge deck crane, which makes a middle axis position of a top plate of a mounted beam segment acted through the bridge deck crane has relatively large downward deflection deformation. Meanwhile, for a beam segment to be mounted, under the constraint of lifting point and the self-weight effect of the beam segment to be mounted, steel boxes of the beam segment to be mounted have downward deflection, and a middle axis position of a top plate of the beam segment to be mounted has reverse upwards deflection. Under the superposition of both actions, there is a relative deformation height difference greater than 5 cm between the middle axis positions of the top plate of both beam segments through aligning the longitudinal partition plates for positioning. When a matching height difference is less than 3 cm, supporting bases are generally used for matching connection. However, when the matching height difference between the beam segments is too large, it is difficult for matching parts of the supporting bases to connect, and the local stress at the connection may be too large, resulting in the welding operation cannot be performed. Meanwhile, in this case, due to deformation of the beam segment is relatively large, the bridge deck also has the problem of stress overrun. There are some shortcomings in rectifying the deviation of double-sided steel box UHPC composite beams using traditional methods such as the matching parts of the supporting bases: (1) When the deformation amount of the matching height difference is greater than 5 cm, and the amount of surcharge loading measures is large. If the supporting bases are used for forced matching, the required measure force is relatively large. (2) Forced matching connection of the supporting bases may result in significant residual stress in the local area, which will affect the mounting quality of steel beams. (3) Through calculation, although the bridge deck is made of the ultra-high-performance concrete (UHPC) material, the bridge deck has a relatively large tensile stress in this hoisting condition, with extremely high risk of cracking.

A construction method of preventing faulting of slab ends of a wide PK (Pasco-Kennewick) composite box beam of a cable-stayed bridge is provided through Chinese patent No. CN105803948B. In this method, before a connected beam segment is completely connected to a beam segment to be connected, the step of tensioning a stay cable of the beam segment to be connected for the first time in advance, a front fulcrum force of a bridge deck crane at the connected beam segment is unloaded, such that transverse deformation of the connected beam segment due to the front fulcrum force of the bridge deck crane during a hoisting process of the connected beam segment is rebound to zero, and the connected beam segment and the beam segment to be connected can be well matched and connected. However, compared with the wide PK composite box beam, stiffness of a transverse beam web between two steel boxes in the double-sided steel box UHPC composite beam is relatively small, showing a shoulder pole effect that both sides are rigid and a middle portion is flexible in the hoisting process, and the transverse beam web is relatively large in deformation, the matching height difference between the connected beam segment and the beam segment to be connected cannot be reduced to less than 3 cm only through tensioning the stay cable of the beam segment to be connected for the first time in advance. Moreover, before the step of tensioning the stay cable of the beam segment to be connected for the first time, the pressure of the bridge deck crane hoisting the beam segment to be connected on the connected beam segment easily results in a large deformation and damage of a bridge deck on the connected beam segment. Therefore, this method is not suitable for the double-sided steel box UHPC composite beam.

In order to solve the problem above, a mounting method of a main beam of a double-sided steel box UHPC composite beam cable-stayed bridge and composite beam thereof are provided.

SUMMARY

An objective of the present disclosure is to provide a mounting method of a main beam of a double-sided steel box UHPC composite beam cable-stayed bridge and composite beam thereof. Through the mounting method, the faulting of slab ends between the beam segments can be reduced, the beam segment assembly quality can be improved, the construction amount for tensioning a stay cable can be reduced, a bridge deck can be prevented from being damaged, and the surcharge loading measures can be reduced.

In order to achieve the objective above, the present disclosure provides the following technical solution:

A mounting method of a main beam of a double-sided steel box UHPC composite beam cable-stayed bridge includes the following steps:

- S1: carrying out prestressed tensioning in a transverse direction of the bridge for all beam segments;
- S2: moving a bridge deck crane forward to an end of a mounted end beam segment, and lifting a beam segment to be mounted, after the beam segment to be mounted is lifted, pouring UHPC when a wet joint between a second beam segment and a third beam segment mounted before the end beam segment is in a pre-bending state; carrying out UHPC resting during first weld seam welding of a weld, and initially tensioning a stay cable after the resting is completed;

S3: initially matching and positioning the end beam segment and the beam segment to be mounted;

S4: tensioning a n-th stay cable corresponding to the end beam segment for the first time, completely unloading the bridge deck crane, and placing a spreader on the end beam segment, where weights of the end beam segment and the spreader are born through the n-th stay cable;

S5: mounting matching parts from an area with a small deformation height difference between the end beam segment and the beam segment to be mounted to an area with a large height difference for rectification, and carrying out whole section welding on the end beam segment and the beam segment to be mounted; and S6: tensioning the n-th stay cable for the second time to a designed cable force, wherein the designed cable force is obtained through backward calculation according to an unstressed length of the stay cable when the bridge is completed, and an unstressed length of the n-th stay cable reaches an unstressed length of the stay cable in a final completed bridge state after the n-th stay cable is tensioned for the second time.

Preferably, in Step 1, the prestressed tensioning in the transverse direction includes: tensioning steel strands of transverse prestressing devices through a tensioning jack, where the transverse prestressing devices are arranged at a bottom of the end beam segment.

Preferably, the transverse prestressing devices are mounted at an end, adjacent to the beam segment to be mounted, of the bottom of the end beam segment. Multiple transverse prestressing devices are mounted, where part of the transverse prestressing devices are mounted on a normal transverse beam section of the double-sided steel box UHPC composite beam, and the other part of the transverse prestressing devices are mounted on a small transverse beam section of the double-sided steel box UHPC composite beam.

Preferably, Step 1 further includes: mounting the transverse prestressing devices on the beam segment to be mounted, and initially tensioning the beam segment to be mounted.

Preferably, in Step 2, the bridge deck crane is moved forwards to a normal transverse beam section of the double-sided steel box UHPC composite beam with an end adjacent to the end beam segment for lifting, and a small transverse beam section of the double-sided steel box UHPC composite beam is used as an auxiliary support.

Preferably, Step 3 further includes: initially adjusting the beam segment to be mounted through the bridge deck crane, and carrying out initial matching and positioning through fixing devices arranged at the end beam segment and the beam segment to be mounted.

Preferably, the fixing devices of the end beam segment and the beam segment to be mounted are adjacent to assembly end faces of both beam segments, each fixing device comprises a steel structure device with a through hole, and a steel screw. During initial matching and positioning, the beam segment to be mounted is lifted to a preset position, and after the initial adjustment of the bridge deck crane, the steel screws pass through the through holes of the steel structure devices of the end beam segment and the beam segment to be mounted in sequence, and then nuts are screwed to complete the initial matching and positioning.

A double-sided steel box UHPC composite beam includes normal transverse beam sections and small transverse beam sections assembled along a length direction of a bridge at intervals. Each normal transverse beam section includes a normal transverse beam web located in a middle portion of the normal transverse beam section, steel boxes arranged at both sides of the normal transverse beam web, and left and right pedestrian cantilevers arranged at outermost sides of the normal transverse beam section, the normal transverse beam web; and the steel boxes and the cantilevers are welded to each other. Each small transverse beam section includes a small transverse beam web located in a middle portion of the small transverse beam section, steel boxes arranged at both sides of the small transverse beam web, and left and right pedestrian cantilevers arranged at outermost sides of the small transverse beam section, and the small transverse beam web, the steel boxes and the cantilevers are welded to each other. The stiffness of the small transverse beam web is less than stiffness of the normal transverse beam web.

Preferably, a manhole is formed in each steel box.

Compared with the prior art, the present disclosure has the following technical effects:

1. The present disclosure can effectively cooperate with the pouring of UHPC at a wet joint, the UHPC is poured when the wet joint between a second beam segment and a third beam segment mounted before the end beam segment is in a pre-bending state. UHPC resting is carried out during first weld seam welding, the stay cable is initially tensioned after the resting, and preload is applied to the UHPC at the wet joint through tensioning of the stay cable and deformation of a pre-bent steel beam, thus ensuring engineering quality of the wet joint and improving construction efficiency. Further, in the present disclosure, a faulting of slab ends in the hoisting process of the beam segment can be reduced, the assembly quality of the beam segments can be improved, and tension times of the stay cable can be reduced.
2. In the present disclosure, the transverse prestressing devices are used to carry out transverse tensioning on the bottom of the end beam segment before the bridge deck crane is moved forwards to the end beam segment, the end beam segment has upwards deflection, such that when the bridge deck crane travels to the end of the end beam segment, the downward deflection of the end beam segment under the self-weight load of the bridge deck crane can be counteracted, thereby reducing the downward deflection of the end beam segment and facilitating the matching and assembly between the end beam segment and the beam segment to be mounted.
3. The traverse prestressing devices of the present disclosure are arranged on an end, adjacent to the beam segment to be mounted, of the normal transverse beam section at an action position of the bridge deck crane, and a small transverse beam section at the end of a transverse beam of the end beam segment, respectively. The transverse prestressing devices arranged on the end, adjacent to the beam segment to be mounted, of the normal transverse beam section at an action position of the bridge deck crane can counteract an action force when the bridge deck crane hoists the beam segment to be mounted, and the traverse prestressing devices arranged on the small transverse beam section at the end of the transverse beam of the end beam segment can further control deformation of the end of the transverse beam of the end beam segment, such that the end of the transverse beam of the end beam segment can be smoothly welded with a transverse beam of the beam segment to be mounted.
4. In the present disclosure, the first tensioning process of the stay cable of the beam segment to be mounted is advanced before matching and welding of the end beam segment and the beam segment to be mounted, a vertical component of the stay cable of the beam segment to be mounted is equal to the self-weight of the beam segment to be mounted plus the weight of the spreader, the bridge deck crane is completely unloaded to release the pressure of the bridge deck crane on the end beam segment, so as to reduce the downward deflection deformation of the end beam segment. In combination with the transverse prestressing device, a height difference between the end beam segment and the beam segment to be mounted is less than 1 cm, thus facilitating the matching and welding between the beam segments.

5. The designed cable force and cable length of the stay cable of the present disclosure are controlled according to an unstressed length of a completed cable-stayed bridge. Based on line shape control, there is no need for multiple tensioning of the stay cable in the process, and thus the construction amount of the multiple tensioning the stay cable is reduced.
6. In the present disclosure, the transverse prestressing devices and a mounting method of advancing a tensioning process of the stay cable of the beam segment to be mounted to before matching and welding are adopted, which makes the downward deflection of the end beam segment is relatively small in a whole construction process, the bridge deck of the end beam segment is prevented from being damaged due to large tensile stress, and the safety of the structure is guaranteed.
7. The present disclosure greatly reduces the amount of surcharge loading measures of the beam segment to be mounted through providing the transverse prestressing devices and advancing the first tensioning process of the stay cable of the beam segment to be mounted to before the matching and welding of the end beam segment and the beam segment to be mounted, such that the height difference between the end beam segment and the beam segment to be mounted is controlled in a small range, which greatly reduces the number of measures for surcharge loading of the beam segment to be mounted.

BRIEF DESCRIPTION OF THE DRAWINGS

To describe the technical solutions of the present disclosure or in the prior art more clearly, the following briefly introduces the accompanying drawings required for describing the embodiments. Apparently, the accompanying drawings in the following description show merely some embodiments of the present disclosure, and those of ordinary skill in the art may still derive other drawings from these accompanying drawings without creative efforts.

Figure 1:
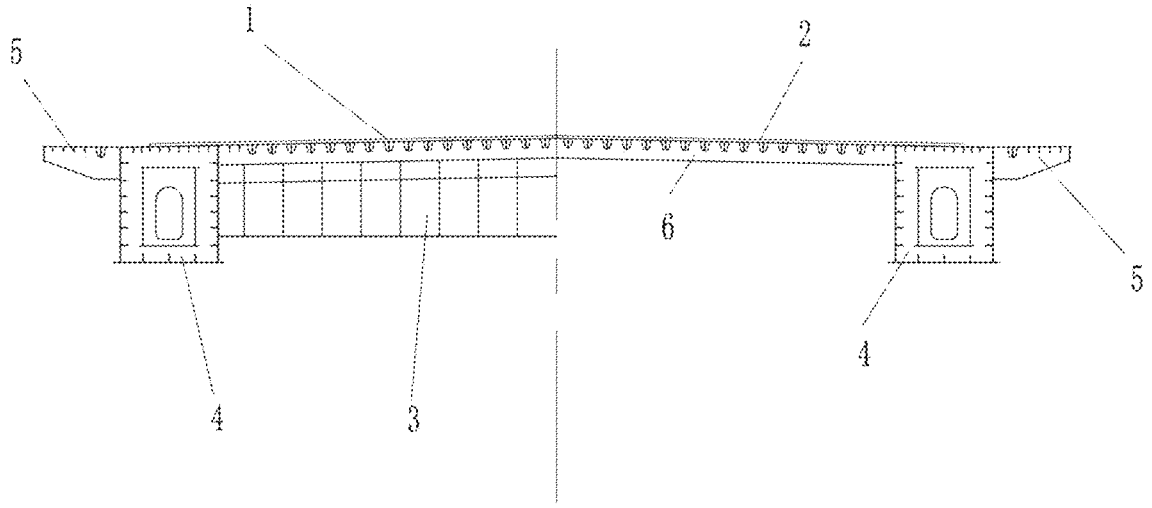
FIG. 1 is a structural schematic diagram of a double-sided steel box UHPC composite beam according to the present disclosure.

In the drawings: 1—normal transverse beam section; 2—small transverse beam section; 3—normal transverse beam web; 4—steel boxes; 5—cantilevers; 6—small transverse beam web; 7—bridge deck crane; 8—end beam segment; 9—beam segment to be mounted; 10—transverse prestressing devices; 11—fixing devices; 12—steel structure devices; 13—steel screws; 14—n-th stay cable; 15—matching parts.

DETAILED DESCRIPTION OF THE EMBODIMENTS

The following clearly and completely describes the technical solutions in the embodiments of the present disclosure with reference to the accompanying drawings in the embodiments of the present disclosure. Apparently, the described embodiments are merely a part rather than all of the embodiments of the present disclosure. All other embodiments obtained through a person of ordinary skill in the art based on the embodiments of the present disclosure without creative efforts shall fall within the protection scope of the present disclosure.

An objective of the present disclosure is to provide a mounting method of a main beam of a double-sided steel box UHPC composite beam cable-stayed bridge and composite beam thereof. Through the mounting method, the faulting of slab ends between the beam segments can be reduced, the beam segment assembly quality can be improved, the construction amount for tensioning a stay cable can be reduced, a bridge deck can be prevented from being damaged, and the surcharge loading measures can be reduced.

In order to make the objectives, features and advantages of the present disclosure can be more obvious and understandable, the present disclosure is further described in detail below with reference to the embodiments.

Figure 2:
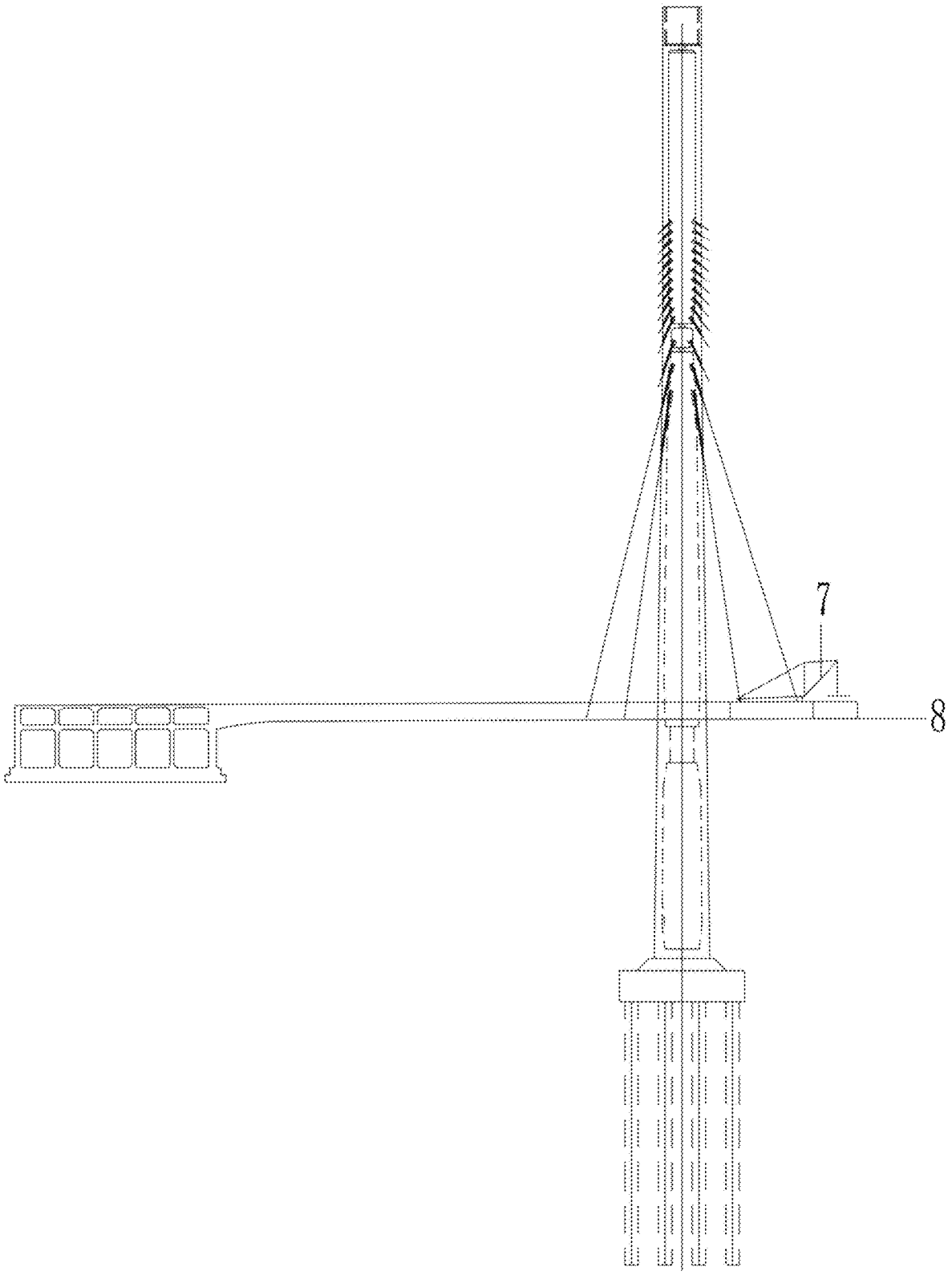
FIG. 2 is a diagram showing a mounting state of a beam segment according to the present disclosure when an end beam segment is subjected to transverse prestressed tensioning.

S1. Transverse prestressed tensioning: as shown in FIG. 2, after the prefabrication of a beam segment is completed, transverse prestressing devices are used to conduct transverse prestressed tensioning on the beam segment.

Each transverse prestressing device 10 includes positioning devices arranged at bottoms of two steel boxes 4 of the beam segments, and a steel strand with both ends fastened to the two fixing devices.

Figure 4:
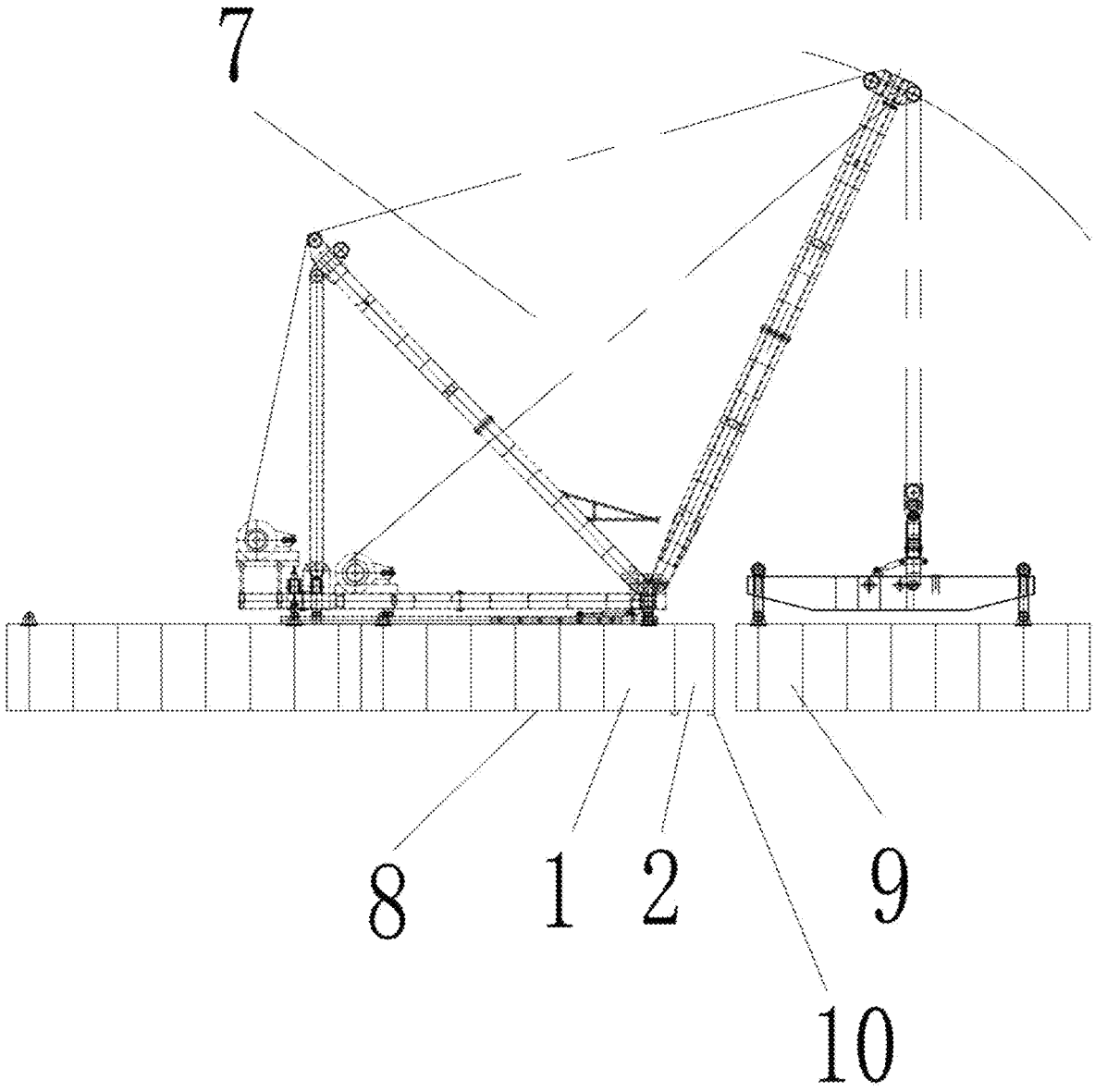
FIG. 4 is a structural schematic diagram of a bridge deck crane lifts a beam segment to be mounted in FIG. 3.

As shown in FIG. 4, the traverse prestressing devices 10 of the end beam segment 8 are arranged on an end, adjacent to the beam segment 9 to be mounted, of the normal transverse beam section 1 at an action position of the bridge deck crane and a small transverse beam section 2 at an end of the end beam segment 8, respectively. The transverse prestressing devices 10 arranged on the normal transverse beam section 1 at an action position of the bridge deck crane 7 can counteract an action force when the bridge deck crane 7 hoists the beam segment 9 to be mounted, and the traverse prestressing devices 10 arranged on the small transverse beam section 2 at the end of the transverse beam of the end beam segment 8 can further control deformation of the end of the transverse beam of the end beam segment 8, such that the end of the transverse beam of the end beam segment 8 can be smoothly welded with a transverse beam of the beam segment 9 to be mounted.

In this embodiment, there are four sets of transverse prestressing devices 10 in the end beam segment 8. Two sets of transverse prestressing devices 10 are arranged at an end, adjacent to the beam segment 9 to be mounted, of the normal transverse beam section 1, and the other two sets of transverse prestressing devices 10 are arranged on the small transverse beam section 2. The two sets of transverse prestressing devices 10 arranged on the normal transverse beam section 1 are adjacent to inside and outside edges of both steel box 4, respectively, and the two sets of transverse prestressing devices 10 arranged on the small transverse beam section 2 are also adjacent to the inside and the outside edges of both steel box 4, respectively, and are symmetrically arranged with the two sets of transverse prestressing devices 10 arranged on the normal transverse beam section 1.

The transverse prestressing devices 10 have small control tension and simple operation, and is mainly used to control a height of downward deflection at mid-span of the beam segment under the load of the bridge deck crane 7 and an angle of in-plane rotation deformation of the steel box 4, so as to facilitate the lifting of the beam segment 9 to be mounted, and also to reduce the tensile stress of the bridge deck and prevent the bridge deck from being damaged.

The mounting of the transverse prestressing devices 10 on the beam segment 9 to be mounted and the initial tensioning of the beam segment 9 to be mounted are the preparation for the subsequent mounting of the beam segment to be mounted. During the construction of the cable-stayed bridge, a working platform is arranged at a bottom of the beam. Before the beam segment 9 to be mounted is lifted and mounted (i.e. when the beam segment 9 to be mounted is on a beam carrier), the working platform is used for the mounting of the positioning devices, the fixation of the steel strands and initial tensioning operation for the beam segment 9 to be mounted, where the initial tensioning control force is 10 kN. After the beam segment 9 to be mounted is hoisted in place, a subsequent beam segment to be mounted is prepared for mounting. When the bridge deck crane 7 moves further to an end of the beam segment 9 to be mounted, the steel strand is tensioned, and the tensioning force of a single set of transverse prestressing devices 10 is about 50 kN, and the steel strand can be tensioned in place through a small tensioning jack.

Before Step S2, preparation processes for tensioning and mounting of the stay cable are required, such as releasing a cable in a cable tray, spreading the cable on the bridge deck, hanging the cable at a tower end, pre-towing the beam segment, etc.

Figure 3:
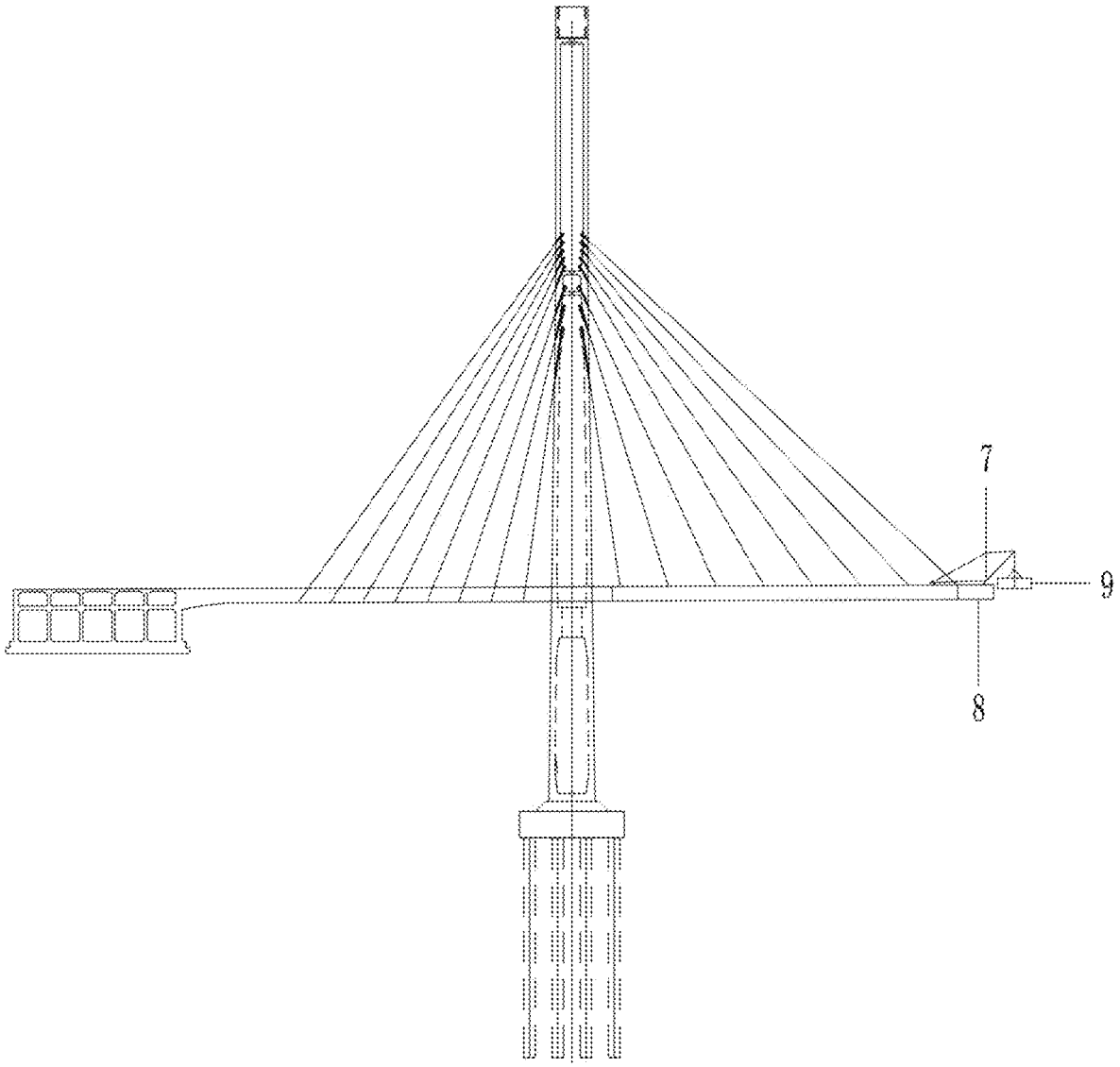
FIG. 3 is a diagram showing a mounting state of a corresponding beam segment according to the present disclosure when a beam segment to be mounted is lifted.

S2. Lifting of the beam segment to be mounted: as shown in FIG. 3 and FIG. 4, the bridge deck crane 7 moves to an end of the end beam segment 8. After the bridge deck crane 7 is in place, hoisting inspection is conducted, and after the inspection is qualified, a spreader 9 is lowered to connect with the beam segment 9 to be mounted that has been transported below, so as to lift the beam segment 9 to be mounted to a height of the bridge deck.

A supporting position of the bridge deck crane 7 and temporary lifting point position are arranged on the normal transverse beam section 1 as far as possible, and the small transverse beam section 2 is used as an auxiliary support to reduce deformation of the small transverse beam section 2.

Figure 6:
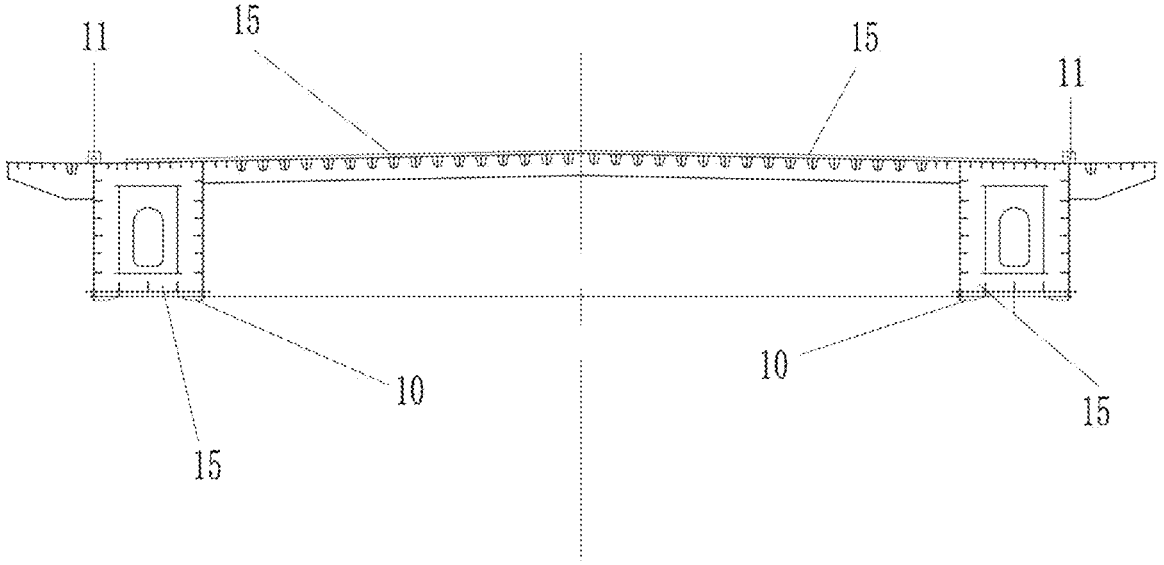
FIG. 6 is a structural schematic diagram of a double-sided steel box UHPC composite beam according to the present disclosure before whole section welding.
Figure 7:
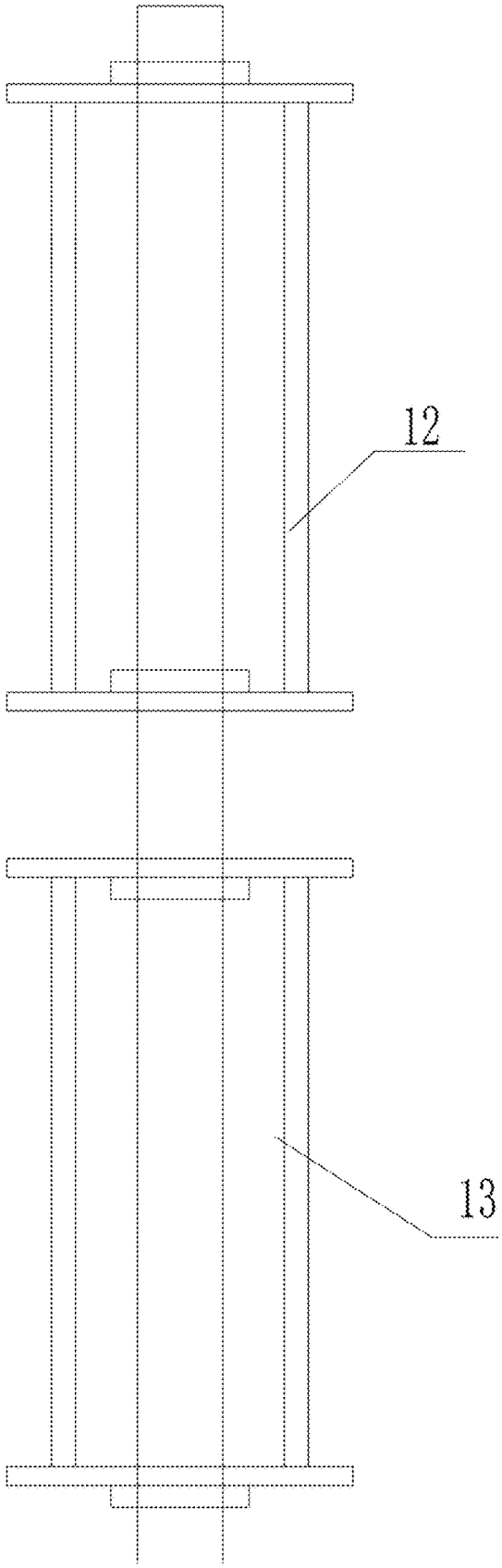
FIG. 7 is a structural schematic diagram of a fixing device of a double-sided steel box UHPC composite beam according to the present disclosure.

S3. Initial matching and positioning of the beam segments: the bridge deck crane 7 is used to initially adjust the beam segment 9 to be mounted, a side, connected to the cantilever 5, of the steel box 4 is used as a reference point for initial matching and positioning. As shown in FIG. 6, the fixing devices 11 are arranged at a joint of the steel box 4 and the pedestrian cantilever 5 of the end beam segment 8 and at a joint of the steel box 4 and the pedestrian cantilever 5 of the beam segment 9 to be mounted, and the fixing devices 11 of both beam segments are adjacent to assembly end faces of the both beam segments. As shown in FIG. 7, each fixing device 11 includes a steel structure device 12 with a through hole, and a steel screw 13. The steel structure devices 12 are welded to the joints of the steel boxes 4 and the pedestrian cantilevers 5. During initial matching and positioning, the beam segment 9 to be mounted is lifted to a preset position, and after initial adjustment of the bridge deck crane 7, the steel screws 13 sequentially passed through the through holes of the steel structure devices 12 of the end beam segment 8 and the beam segment 9 to be mounted, and nuts are screwed to complete the initial matching and positioning.

The initial adjustment of the bridge deck crane 7 includes adjusting an elevation of the beam segment 9 to be mounted, an inclination angle of the beam segment, and a weld seam spacing between top and bottom plates between the beam segments.

Figure 8:
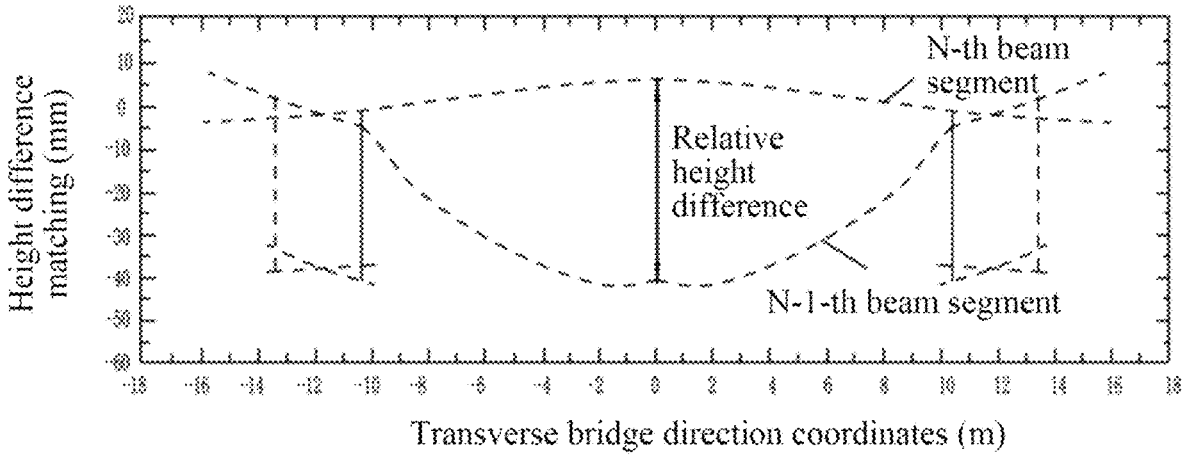
FIG. 8 is a schematic diagram of a relative height difference between an end beam segment and a beam segment to be mounted after initial matching and positioning of beam segments according to the present disclosure.

As shown in FIG. 8, after the initial matching and positioning is completed, there is a matching height difference between the beam segment 9 to be mounted and the mounted end beam segment 8, at this time, the matching height difference is relatively large, and it is impossible to use matching parts 15 to forcibly rectify both beam segments.

Figure 5:
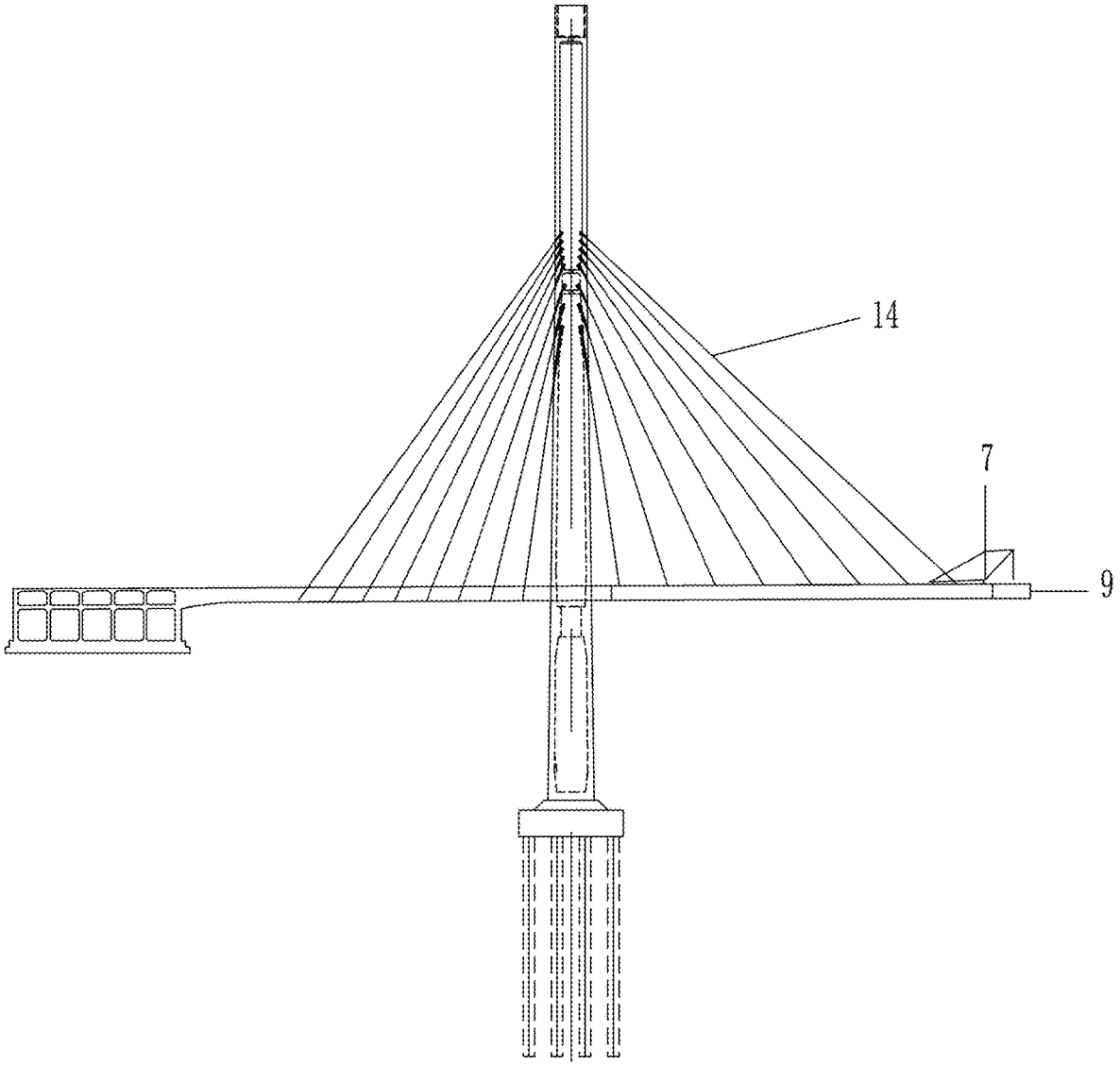
FIG. 5 is a diagram showing a mounting state of a beam segment according to the present disclosure when a n-th stay cable is tensioned for the first time and a bridge deck crane is unloaded.

S4. First tensioning of a n-th stay cable 14 and unloading of bridge deck crane 7: as shown in FIG. 5, the n-th stay cable 14 is pulled through a beam end hoist, a steel strand, etc. to anchor the beam end in place, and the tensioning is carried out at a tower end through a hydraulic jack, and a tensioning force is controlled to be 80% of the designed cable force. During the tensioning of the n-th stay cable 14, the self-weight of the beam segment 9 to be mounted is borne through the n-th stay cable 14, and the bridge deck crane 7 can be passively unloaded in cooperation. After the unloading is completed, the bridge deck crane 7 lowers the spreader onto the beam segment 9 to be mounted to adjust a line shape of the beam segment to be mounted as a counterweight. During the first tensioning of n-th stay cable 14 and unloading of the bridge deck crane 7, the amount of change in elevation of line shapes of three beam segments near the n-th stay cable 14 are monitored in real time. After the above operations are completed, a maximum deformation height difference between both matched beam segments is less than 1 cm.

Cable force for the first tensioning of the n-th stay cable 14 is 80% of the designed cable force, with a vertical component equal to the self-weight of the beam segment 9 to be mounted plus the weight of the spreader of the bridge deck crane 7. Only the self-weight of the bridge deck crane 7 is applied to the end of the end beam segment 8, and the end beam segment 8 is subjected to the transverse prestressed tensioning, such that the downward deflection of the end of the end beam segment 8 is greatly reduced, finally, the maximum deformation height difference between the end beam segment 8 and the beam segment 9 to be mounted is less than 1 cm, and the condition of assembling both beam segments is reached.

S5. Whole section welding: measures of supporting bases assisted matching are adopted to eliminate a residual matching height difference between the beam segment to be mounted and the end beam segment 8. After the mounting of the matching parts 15 are completed, the operation of the whole section welding can be carried out. A mounting sequence of the matching parts 15 is sequential from an area with a small deformation height difference between the beam segments to an area with a large height difference. The matching part is mounted through starting from the area with the small height difference, which makes matching of the matching parts can be completed through small rectification measures, and the amount of measures is relatively small. Meanwhile, the rectification of the area with small height difference will affect other areas, which can reduce the height difference of other areas, facilitate matching and mounting, reduce the generation of a matching stress, and improve the assembly quality between beam segments. As shown in FIG. 6, in this embodiment, the supporting bases are used for rectification, and the rectification is gradually conducted from outsides to insides of the steel boxes 4.

S6. Precise cable adjustment: After welding, the n-th stay cable 14 is tensioned for the second time, and the cable force is tensioned to the designed cable force. At night, a relative line shape, a absolute elevation and other data of the beam segment 9 to be mounted and the end beam segment 8 are monitored and measured for precise cable adjustment. After rechecking, the mounting of the beam segment 9 to be mounted is completed.

In this embodiment, the designed cable force of the stay cable is obtained through backward calculation according to an unstressed length of the stay cable when the bridge is completed, so it is unnecessary to carry out multiple tension control, and it is only required to ensure that the unstressed length of the stay cable remains constant.

Step S1 to Step S6 are cycled to start the mounting of the subsequent beam segment to be mounted.

A matching and mounting method of main beam of a double-sided steel box UHPC composite beam cable-stayed bridge in the embodiment has the following advantages:

1. The transverse prestressing devices 10 are arranged at a bottom of a mounted beam segment for the transverse prestressed tensioning of the mounted beam segment, such that a normal transverse beam web 3 and a small transverse beam web 6 on a cross section of the mounted beam section are deflected upwards to counteract the partial downward deflection of the mounted beam segment caused by the hoisting of a bridge deck crane 7, so as to reduce a height difference between the mounted beam segment and the beam segment to be mounted. The transverse prestressing devices 10 are convenient to assemble, and is suitable for structures such as a double-sided steel box UHPC composite beam with less bridge web stiffness.
2. The designed cable force and cable length of the stay cable are obtained through backward calculation according to the unstressed length of the stay cable when the bridge is completed. The unstressed length of the stay cable is constant, and the cable force of the stay cable is adaptively changed. During the mounting process of the beam segment, it is unnecessary to tension the stay cable for several times. Based on line shape control, the stay cable of the beam segment to be mounted only needs to be tensioned for twice, it is unnecessary to tension the stay cable of the mounted beam segment for the third time to return to a designed state, and thus the amount of construction can be reduced significantly. The reason is that the bridge deck crane 7 is located on the mounted end beam segment 8, and the cable force of the stay cable of the end beam segment 8 is in an over-tensioned state. After the beam segment 9 to be mounted is mounted, the bridge deck crane 7 moves forward to the beam segment 9 to be mounted, and the cable force of the stay cable of the end beam segment 8 will naturally decrease without control and the third tensioning.
3. A tensioning force of the first tensioning of the stay cable of the beam segment to be mounted can pull the beam segment to be mounted and the spreader of the bridge deck crane 7. Under the action of the stay cable and the spreader, the beam segment to be mounted is extremely small in deflection, and the bridge deck crane 7 is completely unloaded without lifting again. The pressure of the bridge deck crane 7 on the mounted beam segment is the self-weight of the bridge deck crane 7. As the mounted beam segment has been tensioned through the transverse prestressing devices 10, the downward deflection caused by the self-weight of the bridge deck crane 7 is counteracted, such that the mounted beam segment is extremely small in deflection, the height difference between both beam segments is controlled within 1 cm, no residual welding stress exists, and welding effect is good.

FIG. 1 is a structural schematic diagram of a double-sided steel box UHPC composite beam. The composite beam is composed through assembling normal transverse beam sections 1 and small transverse beam sections 2 at intervals along a length direction of the bridge. Each normal beam section 1 includes a normal transverse beam web 3 located in a middle portion of the normal transverse beam section, steel boxes 4 arranged at both sides of the normal transverse beam web 3, and left and right pedestrian cantilevers 5 arranged at outermost sides, and the normal transverse beam web 3, the steel boxes 4 and the cantilevers 5 are welded to each other. Each small beam section 2 includes a small transverse beam web 6 located in a middle portion of the small beam section, steel boxes 4 arranged at both sides of the small transverse beam web 6, and left and right pedestrian cantilevers 5 arranged at outermost sides, and the small transverse beam web 6, the steel boxes 4 and the cantilevers 5 are welded to each other. A manhole is formed in each steel box 4. stiffness of the small transverse beam web 6 is less than stiffness of the normal transverse beam web 3. During hoisting, deformation of the small transverse beam web 6 is greater, so a supporting position and a temporary lifting point position of the bridge deck crane 7 should be arranged on the normal transverse beam section 1 as far as possible.

Compared with a wide PK composite box beam, the stiffness of the normal transverse beam web 3 and the small transverse beam web 6 of the double-sided steel box UHPC composite beam are relatively small, thus showing a shoulder pole effect that both sides are rigid and a middle portion is flexible in the hoisting process, and relative deformation is larger in the normal transverse beam web 3 and the small transverse beam web 6. The shoulder pole effect of the PK composite box beam is not obvious due to a transverse partition, so it is impossible to mount the double-sided steel box UHPC composite beam using a mounting method of the PK composite box beam.

Manufacture and transportation of the double-sided steel box UHPC composite beam: steel structure portions of the double-sided steel box UHPC composite beam structure are manufactured in a steel beam processing plant. In order to ensure the pouring quality of UHPC bridge decks, the bridge decks are manufactured on steel beams and cast-in-place directly in the plant, and a post-pouring strip is reserved at connection positions of the beam segments. After the curing of the UHPC is completed, the beam segments 9 to be mounted are transported to a bridge site through a beam carrier.

Adaptive changes made according to actual needs are within the scope of protection of the present disclosure.

It should be noted that it is apparent to those skilled in the art that the present disclosure is not limited to the details of the above exemplary embodiments, and can be achieved in other specific forms without departing from the spirit or basic characteristics of the present disclosure. Therefore, the embodiments should be considered as exemplary rather than limiting in all aspects, and the scope of the present disclosure is defined through the appended claims rather than the above description, so it is intended to embrace all changes that fall within the meaning and range of equivalents of the claims. Any reference signs in the claims should not be regarded as limiting the claims involved.

What is claimed is:

1. A mounting method of a main beam of a double-sided steel box UHPC (ultra-high-performance concrete) composite beam cable-stayed bridge, comprising the following steps:

S1: carrying out prestressed tensioning in a transverse direction of the bridge for all beam segments;

S2: moving a bridge deck crane forward to an end of a mounted end beam segment, and lifting a beam segment to be mounted, after the beam segment to be mounted is lifted, pouring UHPC when a wet joint between a second beam segment and a third beam segment mounted before the end beam segment is in a pre-bending state; carrying out UHPC resting during first weld seam welding between the end beam segment and the beam segment to be mounted, and initially tensioning a stay cable after the resting is completed;

S3: initially matching and positioning the end beam segment and the beam segment to be mounted;

S4: tensioning a n-th stay cable corresponding to the beam segment to be mounted for the first time, completely unloading the bridge deck crane, and placing a spreader of the bridge deck crane on the beam segment to be mounted, wherein weights of the beam segment to be mounted and the spreader are born through the n-th stay cable;

S5: mounting matching parts from an area with a small deformation height difference between the end beam segment and the beam segment to be mounted to an area with a large height difference for rectification, and carrying out whole section welding on the end beam segment and the beam segment to be mounted; and S6: tensioning the n-th stay cable for the second time to a designed cable force, wherein the designed cable force is obtained through backward calculation according to an unstressed length of the stay cable when the bridge is completed, and an unstressed length of the n-th stay cable reaches an unstressed length of the stay cable in a final completed bridge state after the n-th stay cable is tensioned for the second time.

2. The mounting method of a main beam of a double-sided steel box UHPC composite beam cable-stayed bridge according to claim 1, wherein in Step 1, the prestressed tensioning in the transverse direction comprises: tensioning steel strands of transverse prestressing devices through a tensioning jack, wherein the transverse prestressing devices are arranged at a bottom of the end beam segment.

3. The mounting method of a main beam of a double-sided steel box UHPC composite beam cable-stayed bridge according to claim 2, wherein the transverse prestressing devices are mounted at an end, adjacent to the beam segment to be mounted, of the bottom of the end beam segment, several transverse prestressing devices are mounted, wherein part of the transverse prestressing devices are mounted on a normal transverse beam section of the double-sided steel box UHPC composite beam, and the other part of the transverse prestressing devices are mounted on a small transverse beam section of the double-sided steel box UHPC composite beam.

4. The mounting method of a main beam of a double-sided steel box UHPC composite beam cable-stayed bridge according to claim 1, wherein Step 1 further comprises: mounting the transverse prestressing devices on the beam segment to be mounted, and initially tensioning the beam segment to be mounted.

5. The mounting method of a main beam of a double-sided steel box UHPC composite beam cable-stayed bridge according to claim 1, wherein in Step 2, the bridge deck crane is moved forwards to a normal transverse beam section of the double-sided steel box UHPC composite beam with an end adjacent to the end beam segment for lifting, and a small transverse beam section of the double-sided steel box UHPC composite beam is used as an auxiliary support.

6. The mounting method of a main beam of a double-sided steel box UHPC composite beam cable-stayed bridge according to claim 1, wherein Step 3 further comprises: initially adjusting the beam segment to be mounted through the bridge deck crane, and carrying out initial matching and positioning through fixing devices arranged at the end beam segment and the beam segment to be mounted.

7. The mounting method of a main beam of a double-sided steel box UHPC composite beam cable-stayed bridge according to claim 6, wherein the fixing devices of the end beam segment and the beam segment to be mounted are adjacent to assembly end faces of both beam segments, each fixing device comprises a steel structure device with a through hole, and a steel screw; during initial matching and positioning, the beam segment to be mounted is lifted to a preset position, and after the initial adjustment of the bridge deck crane, the steel screws pass through the through holes of the steel structure devices of the end beam segment and the beam segment to be mounted in sequence, and nuts are screwed to complete the initial matching and positioning.

8. A double-sided steel box UHPC composite beam, comprising:

normal transverse beam sections and small transverse beam sections assembled along a length direction of a bridge at intervals, wherein each normal transverse beam section comprises a normal transverse beam web located in a middle portion of the normal transverse beam section, steel boxes arranged at both sides of the normal transverse beam web, and left and right pedestrian cantilevers arranged at outermost sides of the normal transverse beam section, the normal transverse beam web, the steel boxes and the cantilevers are welded to each other;

each small transverse beam section comprises a small transverse beam web located in a middle portion of the small transverse beam section, steel boxes arranged at both sides of the small transverse beam web, and left and right pedestrian cantilevers arranged at outermost sides of the small transverse beam section, the small transverse beam web, the steel boxes and the cantilevers are welded to each other; and stiffness of the small transverse beam web is less than stiffness of the normal transverse beam web.

9. The double-sided steel box UHPC composite beam according to claim 8, wherein a manhole is formed in each steel box.

* * * * *